US009208737B2

(12) United States Patent
Hong et al.

(10) Patent No.: US 9,208,737 B2
(45) Date of Patent: Dec. 8, 2015

(54) SHIFT REGISTER CIRCUIT AND SHIFT REGISTER

(71) Applicant: AU Optronics Corp., Hsin-Chu (TW)

(72) Inventors: Kai-Wei Hong, Hsin-Chu (TW); Pin-Yu Chan, Hsin-Chu (TW); Li-Wei Liu, Hsin-Chu (TW); Yung-Chih Chen, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 0 days.

(21) Appl. No.: 14/325,392

(22) Filed: Jul. 8, 2014

(65) Prior Publication Data

US 2015/0255034 A1 Sep. 10, 2015

(30) Foreign Application Priority Data

Mar. 6, 2014 (TW) ..... 103107741 A

(51) Int. Cl.
*G09G 3/36* (2006.01)

(52) U.S. Cl.
CPC ..... *G09G 3/3674* (2013.01); *G09G 2310/0286* (2013.01)

(58) Field of Classification Search
CPC . G09G 3/3674; G09G 3/3659; G09G 3/3677; G09G 2310/0286
See application file for complete search history.

(56) References Cited

U.S. PATENT DOCUMENTS 7,847,603 B2 12/2010 Fan
8,019,039 B1 * 9/2011 Tsai ..... G11C 19/184 377/64
8,054,104 B2 11/2011 Jarupoonphol
8,396,183 B2 * 3/2013 Yang ..... G09G 3/20 377/64
8,411,074 B2 * 4/2013 Liu ..... G09G 3/20 345/100
8,515,000 B2 * 8/2013 Yang ..... G11C 19/28 377/64
8,890,785 B2 * 11/2014 Lin ..... G09G 3/3659 345/206
8,971,479 B2 * 3/2015 Chang ..... G09G 3/3655 377/64
9,001,013 B2 * 4/2015 Hung ..... G11C 19/00 345/100
2002/0186196 A1 * 12/2002 Park ..... G09G 3/3677 345/100
2010/0238143 A1 * 9/2010 Liu ..... G09G 3/20 345/204
2010/0245298 A1 * 9/2010 Chen ..... G09G 3/3677 345/204
2012/0051494 A1 * 3/2012 Yang ..... G11C 19/28 377/67
2012/0140871 A1 * 6/2012 Yang ..... G09G 3/20 377/79
2012/0328070 A1 * 12/2012 Lin ..... G09G 3/3677 377/70
2013/0002309 A1 * 1/2013 Lee ..... G09G 3/3677 327/108
2013/0100006 A1 * 4/2013 Lin ..... G09G 3/3659 345/94
2013/0321372 A1 * 12/2013 Hung ..... G11C 19/00 345/211
2014/0043373 A1 * 2/2014 Kim ..... G09G 3/02 345/690
2014/0103983 A1 * 4/2014 Chang ..... G09G 3/3655 327/198
2015/0255014 A1 * 9/2015 Lin ..... G09G 3/2092 345/84
2015/0255034 A1 * 9/2015 Hong ..... G09G 3/3659 345/214

* cited by examiner

*Primary Examiner* — Patrick F Marinelli
(74) *Attorney, Agent, or Firm* — Winston Hsu; Scott Margo

(57) ABSTRACT

A shift register circuit has a plurality of shift registers. Each of the shift registers has at least four input terminals, a signal input terminal, an output terminal, a pull-up circuit, a driving circuit, a stability driving circuit, and a pull-down circuit. The signal input terminal receives an input signal, and the pull-up circuit is configured to pull up a voltage level of a node of the shift register. The driving circuit outputs a gate driving signal according to the voltage level of the node. The pull-down circuit is configured to pull down the voltage level of the node. The stability driving circuit can pull down the voltage of the output terminal according to the voltages of the four input terminals, and, thus, can reduce the response time of the shift register circuit and increase the operation region of the shift register circuit.

22 Claims, 9 Drawing Sheets

SHIFT REGISTER CIRCUIT AND SHIFT REGISTER

BACKGROUND OF THE INVENTION

1. Field of the Invention

The invention relates to a shift register circuit and shift register, and more particularly, to a shift register circuit and shift register that have a stability driving circuit.

2. Description of the Prior Art

Generally, a display panel includes a plurality of pixels, gate driving circuit, and source driving circuit. The gate driving circuit includes a plurality stages of shift register and is used to provide a plurality of gate driving signals for turning on and off the pixels. The source driving circuit is used to write the data into the turned-on pixels.

FIG. 1 shows the shift register 100 according to prior art and FIG. 2 shows the timing diagram of the shift register 100 in FIG. 1. The shift register 100 includes switches T1A and T1J. The first terminal of the switch T1A receives the gate driving signal $G_{N-1}$, the second terminal of the switch T1A is coupled to the node $Q_N$, and the control terminal of the switch T1A is coupled to the first terminal of the switch T1A. The first terminal of the switch T1B receives the clock signal HC1, the second terminal of the switch T1B is coupled to the output terminal Out of the shift register 100 to output the gate driving signal $G_N$, and the control terminal of the switch T1B is coupled to the node $Q_N$. The first terminal of the switch T1C is fixed to the high gate voltage level VGH, and the control terminal of switch T1C is coupled to the first terminal of the switch T1C. The first terminal of the switch T1D is coupled to the first terminal of the switch T1C, the second terminal of the switch T1D is coupled to the node $P_N$, and the control terminal of the switch T1D is coupled to the second terminal of the switch T1C. The first terminal of the switch T1E is coupled to the second terminal of the switch T1C, the second terminal of the switch T1E is coupled to the system voltage terminal $V_{SS}$, and the control terminal of the switch T1E is coupled to the node $Q_N$. The system voltage terminal $V_{SS}$ is used to provide the low gate voltage level VGL. The first terminal of the switch T1F is coupled to node $P_N$, the second terminal of the switch T1F is coupled to the system voltage terminal $V_{SS}$, and the control terminal of the switch T1F is coupled to the node $Q_N$. The first terminal of the switch T1G is coupled to the node $Q_N$, the second terminal of the switch T1G is coupled to the output terminal Out, and the control terminal of the switch T1G is coupled to the node $P_N$. The first terminal of the switch T1H is coupled to the out terminal Out, the second terminal of the switch T1H is coupled to the system voltage terminal $V_{SS}$, and the control terminal of the switch T1H is coupled to the node $P_N$. The first terminal of the switch T1I is coupled to the node $Q_N$, the second terminal of the switch T1I is coupled to the output terminal Out, and the control terminal of the switch T1I receives the gate driving signal $G_{N+2}$. The first terminal of the switch T1J is coupled to the output terminal Out, the second terminal of the switch T1J is coupled to the system voltage terminal $V_{SS}$, and the control terminal of the switch T1J receives the gate driving signal $G_{N+2}$. The gate driving signal $G_{N-1}$ is the output signal of the shift register that is one stage prior to shift register 100, and the gate driving signal $G_{N+2}$ is the output signal of the shift register that is two stage next to shift register 100.

In FIG. 2, during the period of T1, the gate driving signal $G_{N-1}$ is raised to the high gate voltage level VGH, the gate driving signal $G_{N+2}$ is kept at the low gate voltage level VGL, and the clock signal HC1 is at the low gate voltage level VGL. The switch T1A is turned on so the voltage level of node $Q_N$ is also raised to the high gate voltage level VGH. Therefore, the switch T1B is turned on and the voltage level of the gate driving signal $G_N$ is kept at the low gate voltage level VGL as the clock signal HC1. Meanwhile, the switches T1C, T1E and T1F are turned on. However, since the driving power of T1E is larger than T1C, the control terminal of the switch T1D is kept at the low gate voltage level VGL and is turned off. Since the switch T1F is turned on, the voltage level of the node $P_N$ is also kept at the low gate voltage level VGL and, thus, the switched T1G and T1H are turned off.

During the period of T2, the gate driving signals $G_{N-1}$ is back to the low gate voltage level VGL, the gate driving signal $G_{N+2}$ remains at the low gate voltage level VGL, and the clock signal HC1 changes to the high gate voltage level VGH. The switch T1A is turned off. The switch T1B is still turned on, which helps to pull up the voltage level of the gate driving signal $G_N$ to the high gate voltage level as the clock signal HC1. The voltage level of the node $Q_N$ is raised to about two times of the high gate voltage level VGH, namely 2VGH, due to the coupling effect of the parasitic capacitor of the switch T1B. The switches T1C, T1E, and T1F are still turned on and the switches T1D, T1G, T1H, T1I, and T1J are still turned off. The voltage level of node $P_N$ remains at the low gate voltage level VGL.

During the period of T3, the gate driving signals $G_{N-1}$ and $G_{N+2}$ both remain at the low gate voltage level VGL, and the clock signal HC1 changes to the low gate voltage level VGL. The switch T1A is turned off. The switch T1B is turned on and helps to pull down the voltage level of the gate driving signal $G_N$ to the low gate voltage level as the clock signal HC1. Meanwhile, the node $Q_N$ is floating so the voltage level of node $Q_N$ will go down as the time goes by. The switches T1C, T1E, and T1F are still turned on, and the switches T1D, T1G, T1H, T1I and T1J are still turned off. The voltage level of node $P_N$ remains at the low gate voltage level VGL.

During the period of T4, the gate driving signal $G_{N-1}$ remains at the low gate voltage level VGL, the gate driving signal $G_{N+2}$ changes to the high gate voltage level VGH, and the clock signal HC1 changes to the high gate voltage level VGH. The switch T1A is still turned off. The switches T1I and T1J are turned on so the voltage level of the gate driving signal $G_N$ is kept at the low gate voltage level VGL and the voltage level of the node $Q_N$ is pulled down to the low gate voltage level VGL as the gate driving signal $G_N$. Meanwhile, the switch T1B, T1E, and T1F are turned off and switches T1C and T1D are turned on so the voltage level of the node $P_N$ is pulled up to the high gate voltage level VGH. Therefore, the switches T1G and T1H are turned on, which help to ensure the voltage level of the node $Q_N$ and the gate driving signal $G_N$ are kept at the low gate voltage level VGL.

As the resolution of the display panel becomes higher and higher, the required time for the source driving circuit of the display panel to transmit a bit pixel is also shortened. However, since the node $Q_N$ of the aforesaid shift register 100 is floating during the period of T3 in FIG. 2, the driving power of the switch T1B to pull down the voltage level of the gate driving signal $G_N$ is rather weak. Consequently, the voltage transition speed of the gate driving signal $G_N$ may not be fast enough and may cause wrong charging or wrong judgment of the display panel.

SUMMARY OF THE INVENTION

One embodiment of the present invention discloses a shift register. The shift register comprises a first input terminal, a second input terminal, a third input terminal, a fourth input terminal, a first signal input terminal, a first output terminal, a first system voltage terminal, a second system voltage terminal, a pull-up circuit, a driving circuit, a stability driving circuit, and a pull-down circuit. The pull-up circuit is coupled to the first signal input terminal and a first node for pulling up a voltage level of the first node according to a voltage level of the first signal input terminal. The driving circuit is coupled to the first node, the first input terminal and the first output terminal for controlling the electrical connection between the first input terminal and the first output terminal according to the voltage level of the first node. The stability driving circuit comprises a capacitor, a first switch, a second switch, a third switch, and a fourth switch. The capacitor has a first terminal coupled to the first node and a second terminal coupled to a second node. The first switch has a first terminal coupled to the second system voltage terminal, a second terminal coupled to the second node, and a control terminal coupled to the first input terminal. The second switch has a first terminal coupled to the second system voltage terminal, a second terminal coupled to the second node, and a control terminal coupled to the second input terminal. The third switch has a first terminal coupled to the second node, a second terminal coupled the first system voltage terminal, and a control terminal coupled to the third input terminal. The fourth switch has a first terminal coupled to the second node, a second terminal coupled to the first system voltage terminal, and a control terminal coupled to the fourth input terminal. The pull-down circuit is coupled to the first node, the first output terminal, the first system voltage terminal and the fourth input terminal for pulling down the voltage level of the first node and the first output terminal according to a voltage level of the fourth input terminal.

Another embodiment of the present invention discloses a shift register circuit. The shift register circuit has a plurality of shift registers and each shift register comprises a first input terminal, a second input terminal, a third input terminal, a fourth input terminal, a first signal input terminal, a first output terminal, a first system voltage terminal, a second system voltage terminal, a pull-up circuit, a driving circuit, a stability driving circuit, and a pull-down circuit. The pull-up circuit is coupled to the first signal input terminal and a first node for pulling up a voltage level of the first node according to a voltage level of the first signal input terminal. The driving circuit is coupled to the first node, the first input terminal and the first output terminal for controlling the electrical connection between the first input terminal and the first output terminal according to the voltage level of the first node. The stability driving circuit comprises a capacitor, a first switch, a second switch, a third switch, and a fourth switch. The capacitor has a first terminal coupled to the first node and a second terminal coupled to a second node. The first switch has a first terminal receiving a system high voltage level, a second terminal coupled to the second node, and a control terminal coupled to the first input terminal. The second switch has a first terminal receiving the system high voltage level, a second terminal coupled to the second node, and a control terminal coupled to the second input terminal. The third switch has a first terminal coupled to the second node, a second terminal coupled the first system voltage terminal, and a control terminal coupled to the third input terminal. The fourth switch has a first terminal coupled to the second node, a second terminal coupled to the first system voltage terminal, and a control terminal coupled to the fourth input terminal. The pull-down circuit is coupled to the first node, the first output terminal, the first system voltage terminal and the fourth input terminal for pulling down the voltage level of the first node and the first output terminal according to a voltage level of the fourth input terminal.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
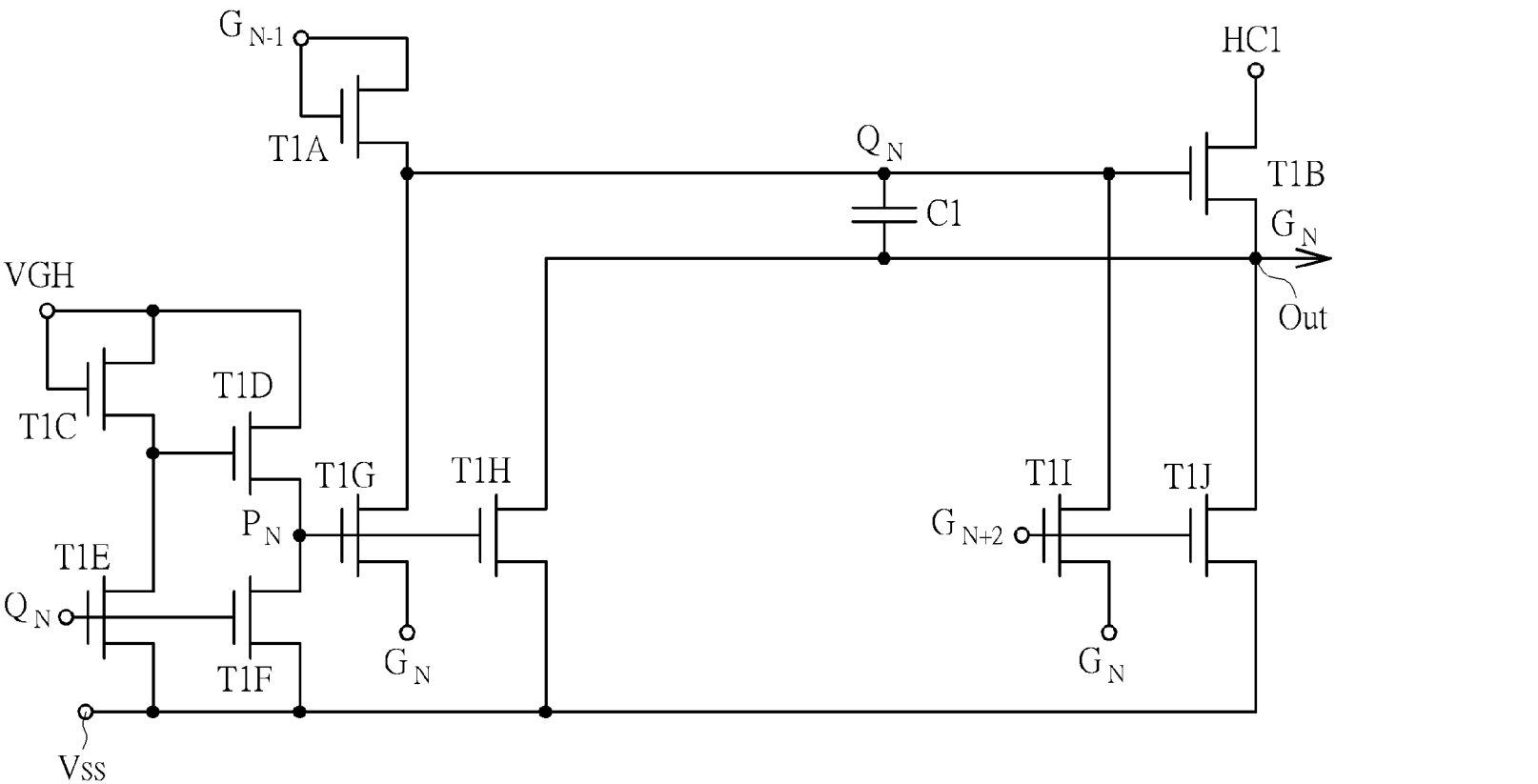
FIG. 1 shows a shift register according to the prior art.
Figure 2:
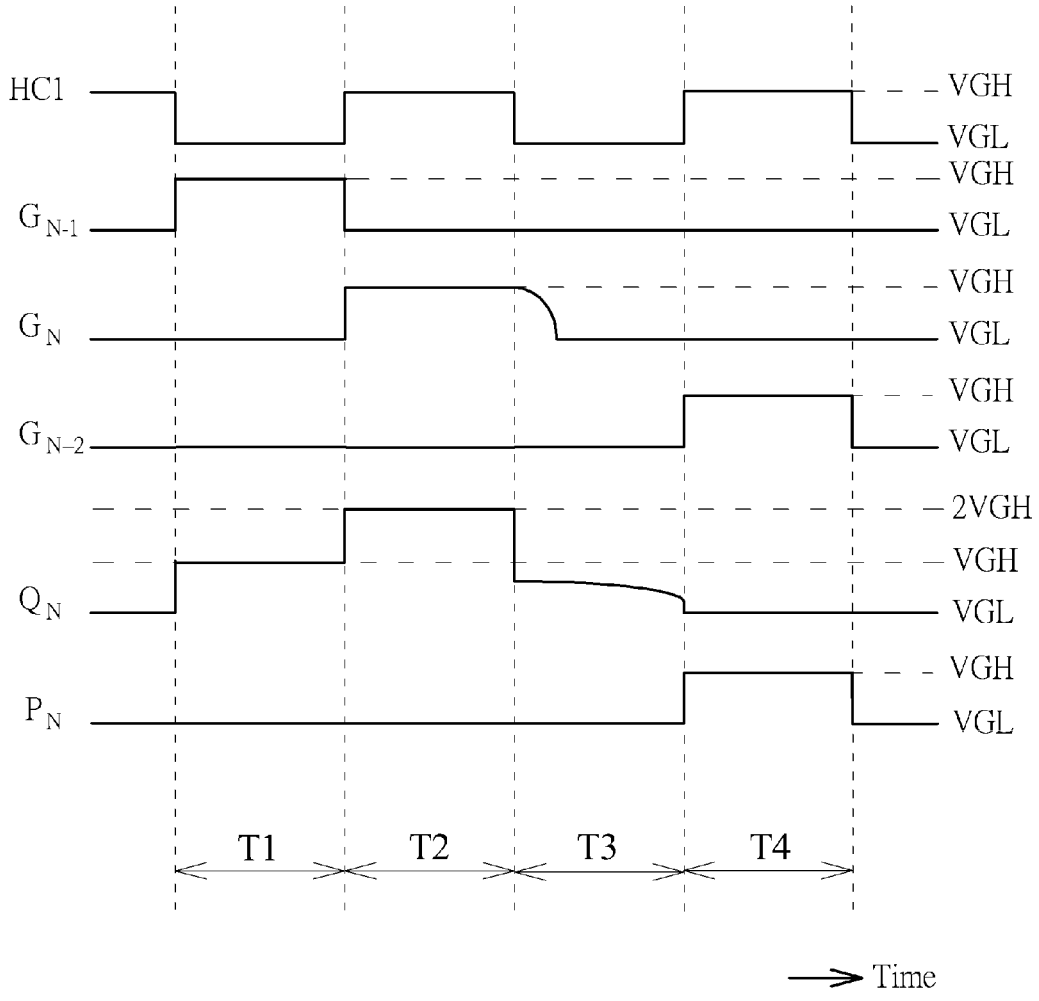
FIG. 2 shows a timing diagram of the shift register in FIG. 1.
Figure 3:
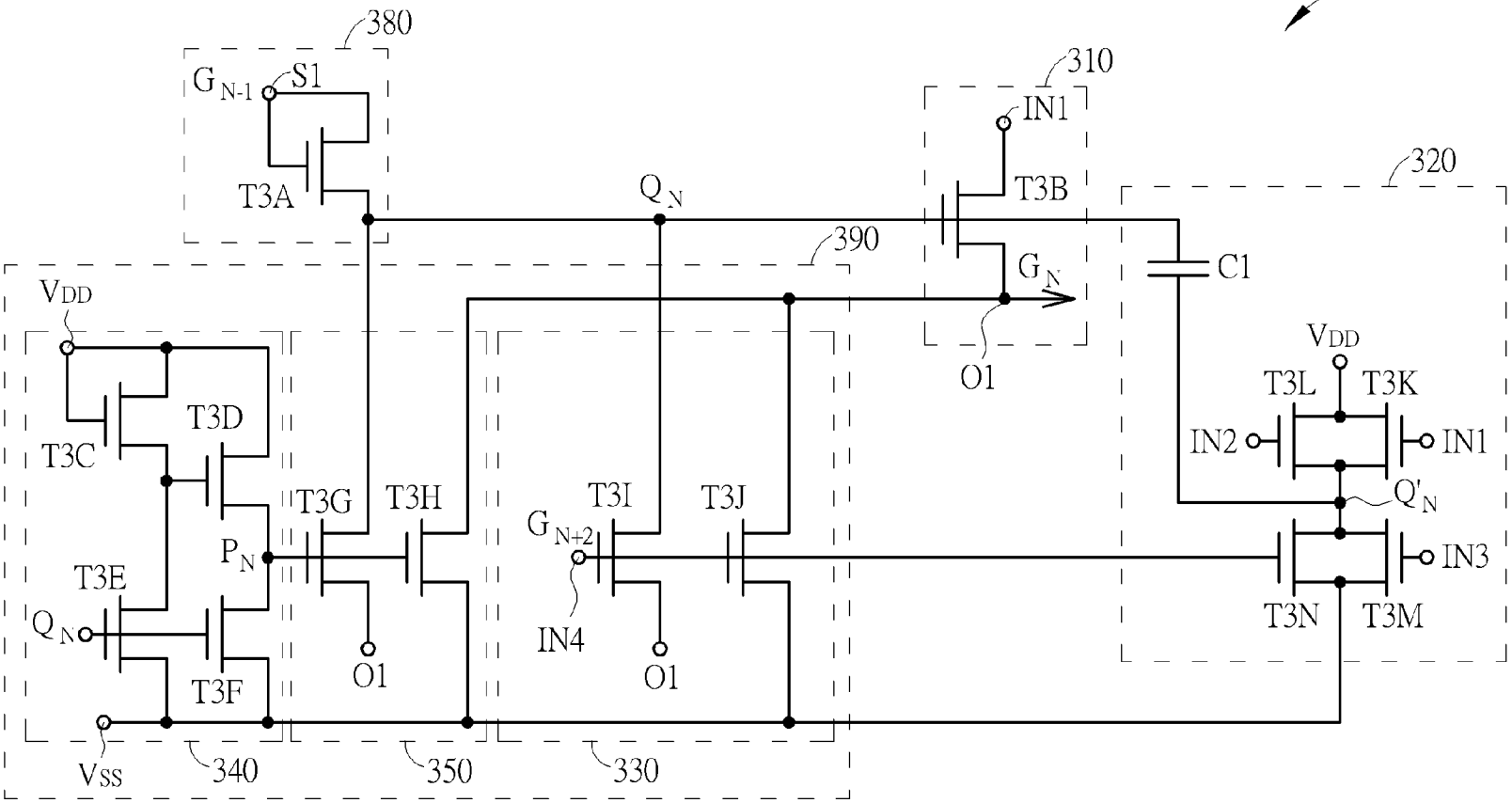
FIG. 3 shows a shift register according to one embodiment of the present invention.

FIG. 3 shows a shift register 300 according one embodiment of the present invention. The shift register comprises a first input terminal IN1, a second input terminal IN2, a third input terminal IN3, a fourth input terminal IN4, a first signal input terminal S1, a first output terminal O1, a first system voltage terminal $V_{SS}$, a second system voltage terminal $V_{DD}$, a pull-up circuit 380, a driving circuit 310, a stability driving circuit 320, and a pull-down circuit 390. The first system voltage terminal $V_{SS}$ can provide a low gate voltage VGL, and the second system voltage terminal $V_{DD}$ can provide a high gate voltage VGH. In one embodiment of the present invention, the high gate voltage VGH is 20V and the low gate voltage VGL is −8V. However, the aforesaid voltage setting is not to limit the present invention. In addition, the first input terminal IN1, the second input terminal IN2, and the third input terminal IN3 are used to receive different clock signals HC1, HC2 and HC4 respectively. The fourth input terminal IN4 is used to receive a gate driving signal $G_{N+2}$, and the first signal input terminal S1 is used to receive a gate driving signal $G_{N-1}$. The gate driving signal $G_{N-1}$ is the output of a shift register that is one stage prior to the shift register 300, and the gate driving signal $G_{N+1}$ is the output of a shift register that is two stages posterior to the shift register 300.

The pull-up circuit 380 is coupled to the first signal input terminal S1 and a node $Q_N$, and is used for pulling up the voltage level of the node $Q_N$ according to the voltage level of the first signal input terminal S1. The driving circuit 310 is coupled to the node $Q_N$, the first input terminal IN1 and the first output terminal O1, and is used for controlling the electrical connection between the first input terminal IN1 and the first output terminal O1 according to the voltage level of the node $Q_N$. The stability driving circuit 320 is coupled to the node $Q_N$, the first input terminal IN1, the second input terminal IN2, the third input terminal IN3, the fourth input terminal IN4 and the first system voltage terminal $V_{SS}$. The stability driving circuit 320 is used to pull down the voltage level of the first node $Q_N$ according to the voltage levels of the first input terminal IN1, the second input terminal IN2, the third input terminal IN3, the fourth input terminal IN4. The pull-down circuit 390 is coupled to the node $Q_N$, the first output terminal O1, the first system voltage terminal $V_{SS}$ and the fourth input terminal IN4, and is used to pull down the voltage levels of the node $Q_N$ and the first output terminal O1 according to the voltage level of the fourth input terminal IN4.

In one embodiment of the present invention, the pull-up circuit 380 comprises a first input switch T3A having a control terminal receiving the gate driving signal $G_{N-1}$, a first terminal coupled to the control terminal of the first input switch T3A, and a second terminal coupled to the node $Q_N$. The driving circuit 310 comprises a switch T3B having a first terminal coupled to the first input terminal IN1, a second terminal coupled to the first output terminal O1, and a control terminal coupled to the node $Q_N$. The stability driving circuit 320 comprises a capacitor C1, switches T3K, T3L, T3M, and T3N. The capacitor C1 has a first terminal coupled to the node $Q_N$ and a second terminal coupled to a node $Q'_N$. The switch T3K has a first terminal coupled to the second system voltage terminal $V_{DD}$, a second terminal coupled to the node $Q'_N$, and a control terminal coupled to the first input terminal IN1. The switch T3L has a first terminal coupled to the second system voltage terminal $V_{DD}$, a second terminal coupled to the node $Q'_N$, and a control terminal coupled to the second input terminal IN2. The switch T3M has a first terminal coupled to the node $Q'_N$, a second terminal coupled the first system voltage terminal $V_{SS}$, and a control terminal coupled to the third input terminal IN3. The switch T3N has a first terminal coupled to the node $Q'_N$, a second terminal coupled to the first system voltage terminal $V_{SS}$, and a control terminal coupled to the fourth input terminal IN4. The pull-down circuit 390 comprises a main pull-down circuit 330, a first stability control circuit 340, and a first stability pull-down circuit 350. The main pull-down circuit 330 is coupled to the node $Q_N$, the first system voltage terminal $V_{SS}$, the fourth input terminal IN4 and the first output terminal O1, and is used for pulling down the voltage level of the first output terminal O1 and the node $Q_N$ according to the voltage level of fourth input terminal IN4. The first stability control circuit 340 is coupled to the node $Q_N$, the first system voltage terminal $V_{SS}$ and a node $P_N$ for controlling the voltage level of the node $P_N$ according to the voltage level of the node $Q_N$. The first stability pull-down circuit 350 is coupled to the node $Q_N$, the first system voltage terminal $V_{SS}$, the first output terminal O1 and the node $P_N$, and is used for pulling down the voltage levels of the node $Q_N$ and the first output terminal O1 according to the voltage level of the node $P_N$.

In one embodiment of the present invention, the main pull-down circuit 330 comprises switches T3I and T3J. The switch T3I has a first terminal coupled to the node $Q_N$, a second terminal coupled to the first output terminal O1, and a control terminal coupled to the fourth input terminal IN4. The switch T3J has a first terminal coupled to the first output terminal O1, a second terminal coupled to the first system voltage terminal $V_{SS}$, and a control terminal coupled to the fourth input terminal IN4. The first stability control circuit 340 comprises switches T3C, T3D, T3E and T3F. The switch T3C has a first terminal coupled to the second system voltage terminal $V_{DD}$, a second terminal, and a control terminal coupled to the first terminal of the switch T3C. The switch T3D has a first terminal coupled to the second system voltage terminal $V_{DD}$, a second terminal coupled to the node $P_N$, and a control terminal coupled to the second terminal of the switch T3C. The switch T3E has a first terminal coupled to the second terminal of the switch T3C, a second terminal coupled to the first system voltage terminal $V_{SS}$, and a control terminal coupled to the node $Q_N$. The switch T3F has a first terminal coupled to the node $P_N$, a second terminal coupled to a first system voltage terminal $V_{SS}$, and a control terminal coupled to the node $Q_N$. The first stability pull-down circuit 350 comprises switches T3G and T3H. The switch T3G has a first terminal coupled to the node $Q_N$, a second terminal coupled to the first output terminal O1, and a control terminal coupled to the node $P_N$. The switch T3H has a first terminal coupled to the first output terminal O1, a second terminal coupled to the first system voltage terminal $V_{SS}$, and a control terminal coupled to the node $P_N$.

Figure 4:
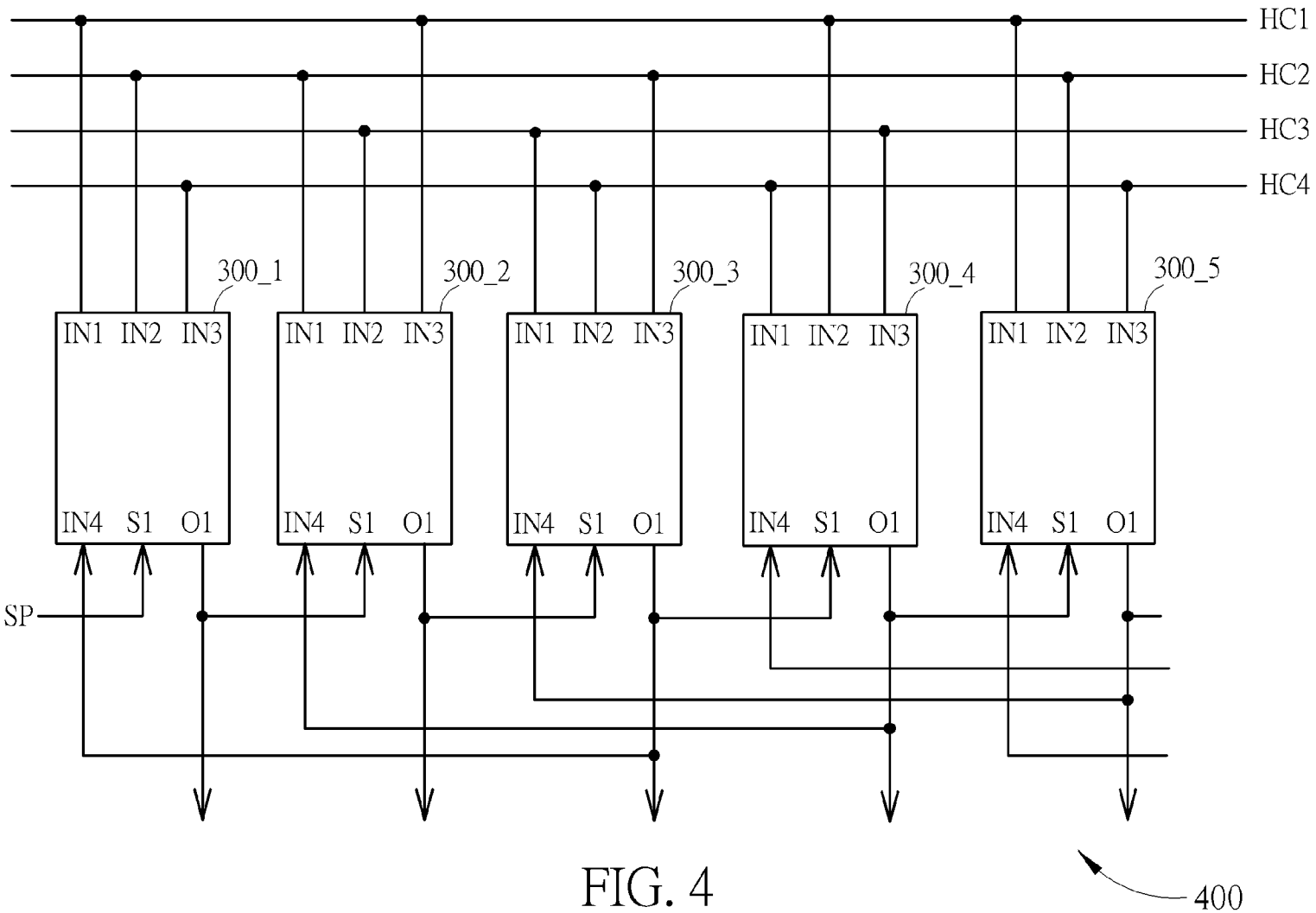
FIG. 4 shows a shift register circuit according to one embodiment of the present invention.
Figure 5:
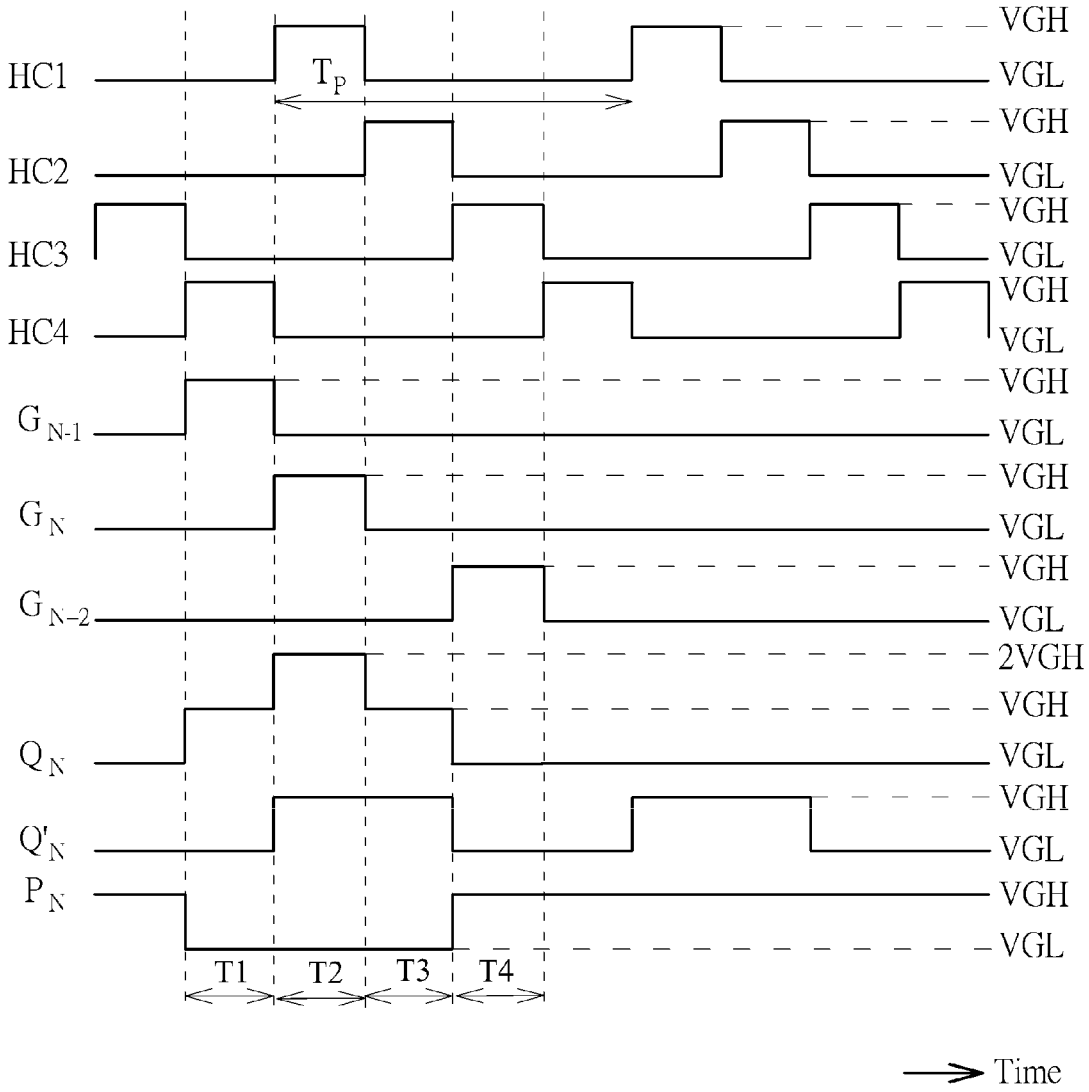
FIG. 5 shows a timing diagram of the shift register circuit in FIG. 4.

The shift register 300 can be used as a gate driver of a display panel. The gate driver can comprise a plurality stage of the shift registers 300 for providing a plurality of gate driving signals to turn on and turn off the pixels of the display panel. FIG. 4 shows a shift register circuit 400 according to one embodiment of the present invention and FIG. 5 shows the timing diagram of the shift register circuit 400 in FIG. 4. The shift register circuit 400 comprises a plurality of shift registers 300 (for example, the shift registers 300_1 to 300_5). Each shift registers 300_1 to 300_5 has the same structure as the shift register 300 in FIG. 3 has. Each of the shift registers 300_1 to 300_5 can output a gate driving signal $G_1$ to $G_5$ from its first output terminal O1 to the corresponding gate line (also called scan line) in turns for turning on the corresponding row of pixels in the display panel. The first signal input terminal S1 of each of the shift registers 300_2 to 300_5 receives gate driving signal $G_1$ to $G_4$ respectively. The driving signals $G_1$ to $G_4$ are outputted from the shift registers 300_1 to 300_4, that is, the shift registers of prior stage. The first signal input terminal S1 of the shift register 300_1 receives an initial signal SP. In one embodiment, the shift register 300_1 can output the gate driving signal $G_1$ firstly, and then the registers 300_2, 300_3, 300_4 can output the gate driving signal $G_2$, $G_3$, and $G_4$ in turns. The shift register 300_5 is the last shift register to output the driving signal $G_5$ among the five shift registers 300_1 to 300_5.

Furthermore, the first input terminal IN1, the second input terminal IN2, and the third input terminal IN3 of each of the shift registers 300_1 and the 300_5 receive the clock signals HC1, HC2 and HC4. The first input terminal IN1, the second input terminal IN2, and the third input terminal IN3 of the shift register 300_2 receive the clock signals HC2, HC3 and HC1 respectively. The first input terminal IN1, the second input terminal IN2, and the third input terminal IN3 of the shift register 300_3 receive the clock signals HC3, HC4 and HC2 respectively. The first input terminal IN1, the second input terminal IN2, and the third input terminal IN3 of the shift register 300_4 receive the clock signals HC4, HC1 and HC3 respectively. The voltage levels of the clock signals HC1, HC2, HC3 and HC4 are switching between the high gate voltage VGH and the low gate voltage VGL. In addition, the voltage level of each of the clock signals HC1, HC2, HC3 and HC4 switches from low gate voltage VGL to high gate voltage VGH periodically and the clock signals HC1, HC2, HC3 and HC4 have the voltage level at high gate voltage VGH in different time without overlapping. In FIG. 5, the clocks signals HC1, HC2, HC3 and HC4 have the same period $T_P$, and the voltage levels of the clock signals HC1, HC2, HC3 and HC4 become high gate voltage VGH sequentially. In one embodiment of the present invention, the phase difference between clock signal HC2 and cock signal HC1 is 90°, the phase difference between clock signal HC3 and cock signal HC1 is 180°, the phase difference between clock signal HC4 and cock signal HC1 is 270°.

Also, in one embodiment of the present invention, the shift register circuit 400 is operated according to the four clock signals HC1 to HC4, and thus is called a four phase shift register circuit. Consequently, the clock signals received by the three input terminals IN1 to IN3 of the $N^{th}$ shift register in shift register circuit 400 are the same as the clock signals received by the three input terminals IN1 to IN3 of the $(N+4)^{th}$ shift register in shift register circuit 400, wherein N is a positive integer. For example, the first input terminal IN1, the second input terminal IN2, and the third input terminal IN3 of the first shift register 300_1 receive the clock signals HC1, HC2, and HC4 respectively, and the first input terminal IN1, the second input terminal IN2, and the third input terminal IN3 of the first shift register 300_5 also receive the clock signals HC1, HC2, and HC4. However, the present invention is not limited to the aforesaid example. One can also expand the phase number of the shift register 400 according to the system needs.

FIG. 5 is the timing diagram of the shift register 300_1 of the shift register circuit 400 in FIG. 4. FIG. 5 can help to explain the features and advantages of the shift register 300 in FIG. 3. During period T1, the voltage levels of clock signals HC1 and HC2 are both at low gate voltage VGL, the voltage level of the clock signal HC3 is changed from the high gate voltage VGH to the low gate voltage VGL, and the voltage level of the clock signal HC4 is changed from the low gate voltage VGL to the high gate voltage VGH. The voltage level of the gate driving signal $G_{N-1}$ is at the high gate voltage VGH, and the voltage level of the gate driving signal $G_{N+2}$ is at the low gate voltage VGL. The switch T3A of the pull-up circuit 380 is turned on so the voltage level of the node $Q_N$ is pulled up to the same voltage level of the gate driving signal $G_{N-1}$, namely, the high gate voltage VGH. The switch T3B of the driving circuit 310 is also turned on. Thus, the voltage level of the gate driving signal $G_N$ is kept at the same voltage level of the clock signal HC1, namely, the low gate voltage VGL. The switches T3K, T3L, and T3N of the stability driving circuit 320 are all turned off and the switch T3M is turned on so the voltage level of the node $Q'_N$ is kept at the low gate voltage VGL. Furthermore, the switches T3C, T3E, and T3F of the first stability control circuit 340 are turned on. However, since the driving power of the switch T3E is greater than the switch T3C, the switch T3D is turned off and the voltage level of the node $P_N$ is kept at the low gate voltage VGL. The switches T3G and T3H of the first stability pull-down circuit 350 are turned off, and the switches T3I and T3J of the main pull-down circuit 330 are also turned off.

During the period T2, the voltage level of clock signal HC1 is changed to the high gate voltage VGH, the voltage level of the clock signals HC2 and HC3 are at the low gate voltage VGL, and the voltage level of the clock signal HC4 is changed from the high gate voltage VGH to the low gate voltage VGL. The voltage level of the gate driving signal $G_{N-1}$ is changed to the low gate voltage VGL, and the voltage level of the gate driving signal $G_{N+2}$ is also at the low gate voltage VGL. The switch T3A of the pull-up circuit 380 is turned off and the switch T3B of the driving circuit 310 is still turned on. Thus, the voltage level of the gate driving signal $G_N$ is pulled up to the same voltage level of the clock signal HC1, namely, the high gate voltage VGH. The switches T3L, T3M, and T3N of the stability driving circuit 320 are all turned off and the switch T3K is turned on so the voltage level of the node $Q'_N$ is pulled up to the high gate voltage VGH. Meanwhile, the voltage level of the node $Q_N$ is pulled up to about 2 times the high gate voltage VGH, namely 2VGH, due to the coupling effect of the capacitor C1. Furthermore, the switches T3C, T3E, and T3F of the first stability control circuit 340 are turned on and the switch T3D is still turned off so the voltage level of the node $P_N$ is at the low gate voltage VGL. The switches T3G and T3H of the first stability pull-down circuit 350 remain turned off, and the switches T3I and T3J of the main pull-down circuit 330 are also turned off.

During the period T3, the voltage level of clock signal HC1 is changed to the low gate voltage VGL, the voltage level of the clock signal HC2 is changed from the low gate voltage VGL to the high gate voltage VGH, and the voltage level of the clock signals HC3 and HC4 are at the low gate voltage VGL. The voltage level of the gate driving signal $G_{N-1}$ is at the low gate voltage VGL, and the voltage level of the gate driving signal $G_{N+2}$ is also at the low gate voltage VGL. The switch T3A of the pull-up circuit 380 is turned off. The switches T3K, T3M, and T3N of the stability driving circuit 320 are all turned off and the switch T3L is turned on so the voltage level of the node $Q'_N$ is at the high gate voltage VGH. Thus, the voltage level of the node $Q_N$ can be kept at a voltage level higher than the high gate voltage VGH. The switch T3B of the driving circuit 310 remains turned on so the voltage level of the gate driving signal $G_N$ is pulled down to the same voltage level of the clock signal HC1, namely, the low gate voltage VGL. Furthermore, the switches T3C, T3E, and T3F of the first stability control circuit 340 are still turned on and the switch T3D is still turned off so the voltage level of the node $P_N$ is at the low gate voltage VGL. The switches T3G and T3H of the first stability pull-down circuit 350 remain turned off, and the switches T3I and T3J of the main pull-down circuit 330 are also turned off.

During the period T4, the voltage level of clock signals HC1 and HC4 are at the low gate voltage VGL, the voltage level of the clock signal HC2 is changed from the high gate voltage VGH to the low gate voltage VGL, and the voltage level of the clock signal HC3 is changed from the low gate voltage VGL to the high gate voltage VGH. The voltage level of the gate driving signal $G_{N-1}$ is at the low gate voltage VGL, and the voltage level of the gate driving signal $G_{N+2}$ is changed from the low gate voltage VGL to the high gate voltage VGH. The switch T3A of the pull-up circuit 380 is turned off. The switches T3K and T3L of the stability driving circuit 320 are all turned off and the switches T3M and T3M are turned on so the voltage level of the node $Q'_N$ is pulled down to the low gate voltage VGL. Meanwhile, the switches T3I and T3J of the main pull-down circuit 330 are turned on so the voltage level of the node $Q_N$ is pulled down to the low gate voltage VGL rapidly and the switch T3B of the driving circuit 310 is turned off. Furthermore, the switches T3E and T3F of the first stability control circuit 340 are turned off and the switches T3C and T3D are turned on so the voltage level of the node $P_N$ is pulled up to the high gate voltage VGH. Thus, the switches T3G and T3H of the first stability pull-down circuit 350 are turned on, and the voltage level of the node $Q_N$ and the gate driving signal $G_N$ remain at the low gate voltage VGL stably.

In one embodiment of the present invention, the switch T3A to T3F, T3H and T3I can be N-type transistors (ex, N-type TFT or N-type MOSFET), and the control terminal of each of the switch can be the gate of an N-type transistor. Therefore, the process of manufacturing the shift register according to the embodiments of the present invention can be simplified by using fewer masks.

According to the aforesaid embodiments of the present invention, the stability driving circuit 320 of the shift register 300_1 can keep the voltage level of the node $Q'_N$ at the high gate voltage VGH or the low gate voltage VGL according to the clock signals HC1, HC2 and HC4 and the gate driving signal $G_{N+2}$ coming from the shift register two stages posterior. Consequently, the node $Q'_N$ can be free from floating. Meanwhile, during the period when the gate driving signal $G_N$ is pulled down by the shift register 300_1, the node $Q_N$ is kept at high voltage level and thus has stable power to pull down the voltage level of the gate driving signal $G_N$ to the low gate voltage VGL rapidly, ensuring the waveform of the gate driving signal outputted by the shift register remains correct and preventing the display panel from wrong charging or wrong judgment.

Figure 6:
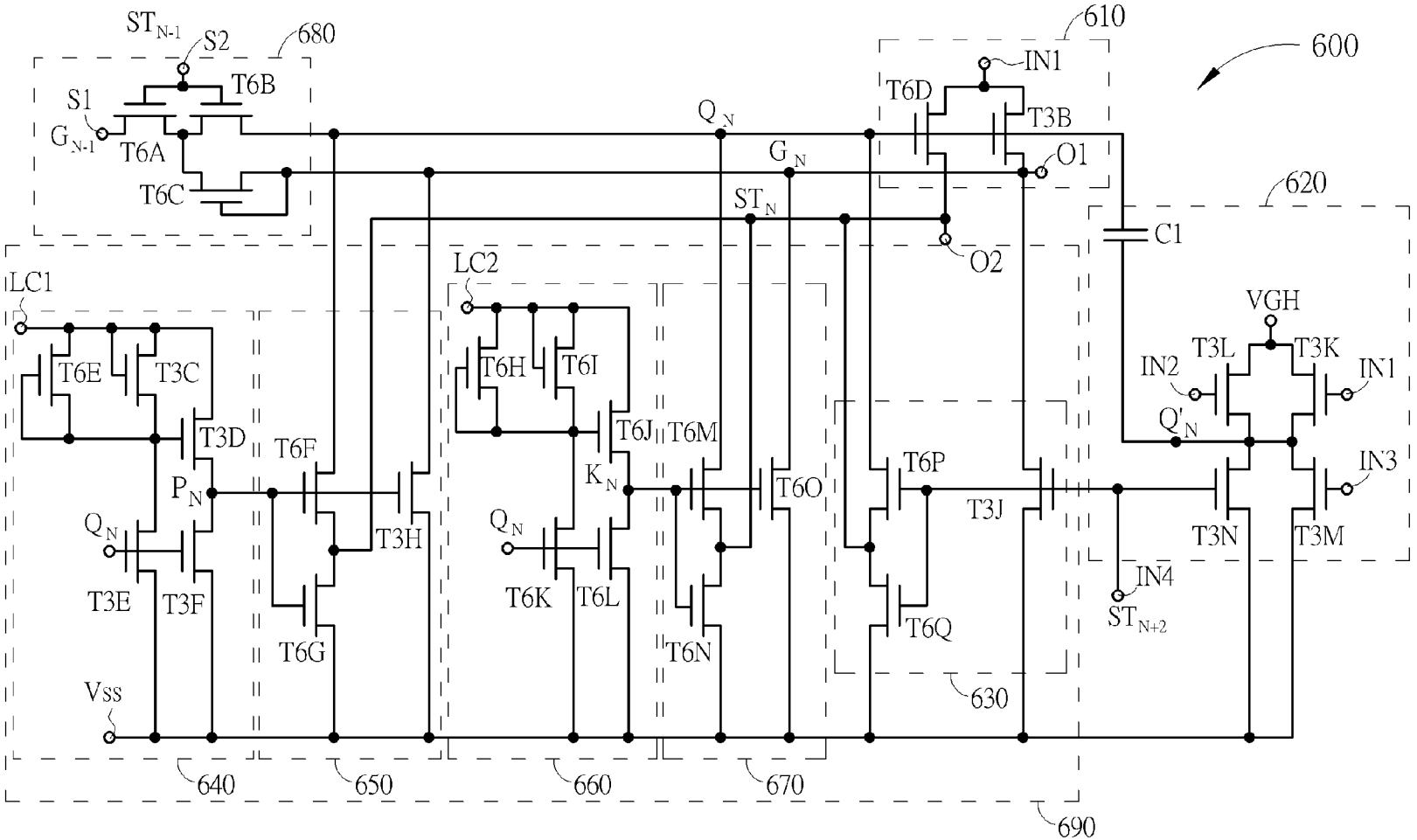
FIG. 6 shows a shift register according to another embodiment of the present invention.

In one embodiment of the present invention, to drive a display panel with larger area, the shift register 300 may further comprise a second output terminal O2. The gate driving signal $ST_N$ outputted by the second output terminal O2 has the same timing and same function as the gate driving signal $G_N$ outputted by the first output terminal O1 does. In addition, to avoid the threshold voltage of the switches of the first stability control circuit 340 and the first stability pull-down circuit 350 in shift register 300 from shifting caused by operating under fixed voltage for long period of time, the pull-down circuit 390 of the shift register 300 may further comprise a second stability control circuit and a second stability pull-down circuit. FIG. 6 shows the shift register 600 according to another embodiment of the present invention. The shift register 600 comprises a first input terminal IN1, a second input terminal IN2, a third input terminal IN3, a fourth input terminal IN4, a first signal input terminal S1, a second signal input terminal S2, a first output terminal O1, a second output terminal O2, a first system voltage terminal $V_{SS}$, a second system voltage terminal LC1, a third system voltage LC2, a pull-up circuit 680, a driving circuit 610, a stability driving circuit 620, and a pull-down circuit 690. The first input terminal IN1, the second input terminal IN2, and the third input terminal IN3 are used to receive different clock signals respectively. The fourth input terminal IN4 is used to receive a gate driving signal $ST_{N+2}$, the first signal input terminal S1 is used to receive a gate driving signal $G_{N-1}$, and the second signal input terminal S2 is used to receive a gate driving signal $ST_{N-1}$. The gate driving signals $G_{N-1}$ and $ST_{N-1}$ are the outputs of the shift register of one stage prior to the shift register 600, and the gate driving signals $ST_{N+2}$ is the output of the shift register of two stages posterior to the shift register 600. Since the gate driving signal $ST_N$ and the gate driving signal $G_N$ have the same timing, the fourth input terminal IN4 can also be used to receive the gate driving signal $G_{N+2}$ in another embodiment of the present invention.

In one embodiment of the present invention, the pull-up circuit 680 comprises input switches T6A T6B and T6C. The first terminal of the input switch T6A is coupled to the first signal input terminal S1, the control terminal of the input switch T6A is coupled to the second signal input terminal S2. The first terminal of the input switch T6B is coupled to the second terminal of the input switch T6A, the second terminal of the input switch T6B is coupled the node $Q_N$, and the control terminal of the input switch T6B is coupled to the second signal input terminal S2. The first terminal of the input switch T6C is coupled to the second terminal of the input switch T6A, the second terminal of the input switch T6C is coupled to the first output terminal O1, and the control terminal of the input switch T6C is coupled to the second terminal of the input switch T6C. The driving circuit 610 comprises switches T3B and T6D. The first terminal of the switch T3B is coupled to the first input terminal IN1, the second terminal of the switch T3B is coupled to the first output terminal O1, and the control terminal of the switch T3B is coupled to the node $Q_N$. The first terminal of the switch T6D is coupled to the first input terminal IN1, the second terminal of the switch T6D is coupled to the second output terminal O2, and the control terminal of the switch T6D is coupled to the node $Q_N$. Furthermore, the stability driving circuit 620 has the same structure as the stability driving circuit 320 in FIG. 3, except that voltage levels of the first terminals of the switches T3K and T3L are fixed to the high gate voltage VGH. The pull-down circuit 690 comprises a main pull-down circuit 630, a first stability control circuit 640, a first stability pull-down circuit 650, a second stability control circuit 660, and a second stability pull-down circuit 670. In addition to the switches T3C, T3D, T3E, and T3F of first stability control circuit 340 in FIG. 3, the first stability control circuit 640 further comprises a switch T6E. The first terminal of the switch T6E is coupled to the second system voltage LC1, the second terminal of the switch T6E is coupled to the second terminal of the switch T3C, and the control terminal of the switch T6E is coupled to the first terminal of the switch T6E. In addition to the switches T3H of the first stability pull-down circuit 350 in FIG. 3, the first stability pull-down circuit 650 further comprises switches T6F and T6G. The first terminal of the switch T6F is coupled to the node $Q_N$, the second terminal of the switch T6F is coupled to the second output terminal O2, and the control terminal of the switch T6F is coupled to the node $P_N$. The first terminal of the switch T6G is coupled to the second output terminal O2, the second terminal of the switch T6G is coupled to the first system voltage $V_{SS}$, and the control terminal of the switch T6G is coupled to the node $P_N$. The second stability control circuit 660 comprises switches T6H, T6I, T6J, T6K, and T6L. The first terminal of the switch T6I is coupled to the third system voltage terminal LC2, and the control terminal of the switch T6I is coupled to the first terminal of the switch T6I. The first terminal of the switch T6J is coupled to the third system voltage terminal LC2, the second terminal of the switch T6J is coupled to the fourth node $K_N$, and the control terminal of the switch T6J is coupled to the second terminal of the switch T6I. The first terminal of the switch T6K is coupled to the second terminal of the switch T6I, the second terminal of the switch T6K is coupled to the first system voltage terminal $V_{SS}$, and the control terminal of the switch T6K is coupled to the node $Q_N$. The first terminal of the switch T6L is coupled to the fourth node $K_N$, the second terminal of the switch T6L is coupled to a first system voltage terminal $V_{SS}$, and the control terminal of the switch T6L is coupled to the node $Q_N$. The first terminal of the switch T6H is coupled to the third system voltage terminal LC2, the second terminal of the switch T6H is coupled to the second terminal of the switch T6I, and the control terminal of the switch T6H is coupled to the second terminal of the switch T6H. The second stability pull-down circuit 670 comprises switches T6M, T6N and T60. The first terminal of the switch T6M is coupled to the node $Q_N$, the second terminal of the switch T6M is coupled to the second output terminal O2, and the control terminal of the switch T6M is coupled to the fourth node $K_N$. The first terminal of the switch T60 is coupled to the first output terminal O1, the second terminal of the switch T60 is coupled to the first system voltage terminal $V_{SS}$, and the control terminal of the switch T60 is coupled to the fourth node $K_N$. The first terminal of the switch T6N is coupled to the second output terminal O2, the second terminal of the switch T6N is coupled to the first system voltage terminal $V_{SS}$, and the control terminal of the switch T6N is coupled to the fourth node $K_N$. In addition to the switch T3J of the main pull-down circuit 330 in FIG. 3, the main pull-down circuit 630 further comprises switches T6P and T6Q. The first terminal of the switch T6P is coupled to the node $Q_N$, the second terminal of the switch T6P is coupled to the second output terminal O2, and the control terminal of the switch T6P is coupled to the fourth input terminal IN4. The first terminal of the switch T6Q is coupled to the second output terminal O2, the second terminal of the switch T6Q is coupled to the first system voltage terminal $V_{SS}$, and the control terminal of the switch T6Q is coupled to the fourth input terminal IN4.

Figure 7:
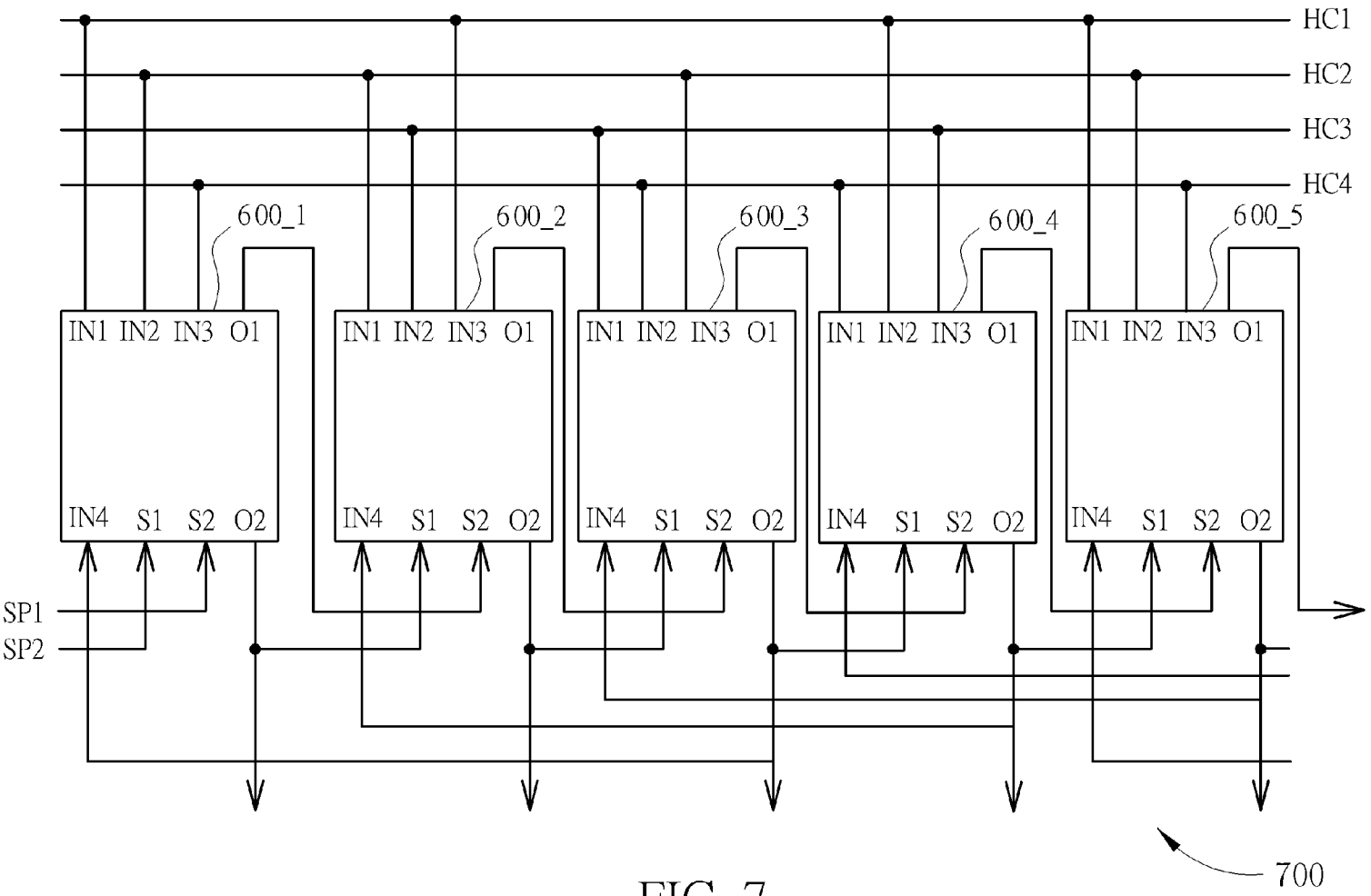
FIG. 7 shows a shift register circuit according to another embodiment of the present invention.
Figure 8:
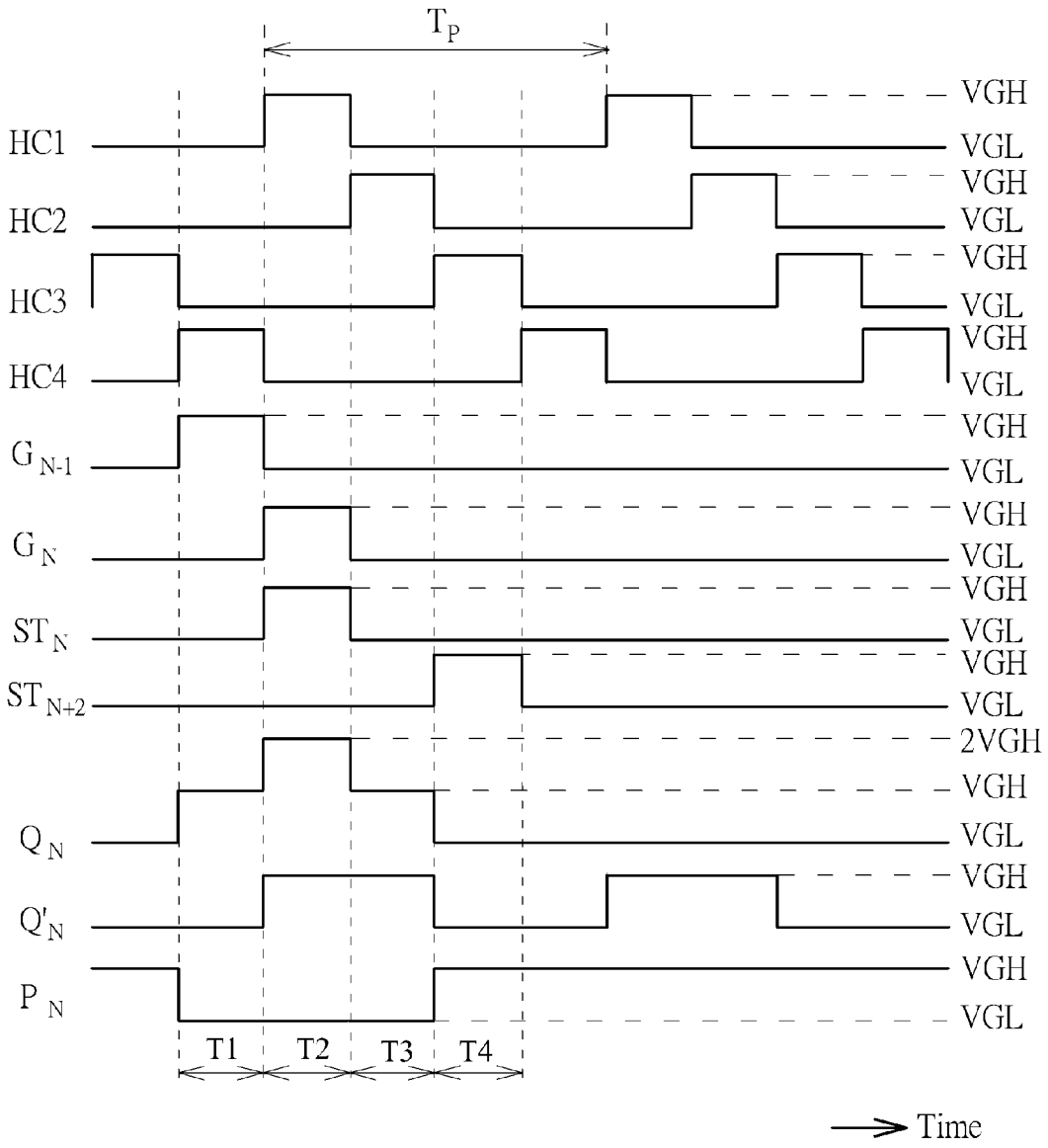
FIG. 8 shows a timing diagram of the shift register circuit in FIG. 7.

The shift register 600 can be used as a gate driver of a display panel. The gate driver can comprise a plurality of stages of the shift registers 600 for providing a plurality of gate driving signals to turn on and off the pixels of the display panel. FIG. 7 shows a shift register circuit 700 according to one embodiment of the present invention and FIG. 8 shows the timing diagram of the shift register circuit 700 in FIG. 7. The shift register circuit 700 comprises a plurality of shift registers 600 (for example, the shift registers 600_1 to 600_5). Each shift registers 600_1 to 600_5 has the same structure as does the shift register 600 in FIG. 6. Each of the shift registers 600_1 to 600_5 can output gate driving signals $G_1$ to $G_5$ and $ST_1$ to $ST_5$ from its first output terminal O1 and second output terminal O2 to the corresponding gate line (also called scan line) in turn for turning on the corresponded row of pixels in the display panel. The first signal input terminal S1 of each of the shift registers 600_2 to 500_5 receives gate driving signals $G_1$ to $G_4$ outputted from the shift registers 600_1 to 600_4 respectively, that is, the shift registers of prior stage. The second signal input terminals S2 of the shift registers 600_2 to 500_5 receive gate driving signals $ST_1$ to $ST_4$ respectively. The first signal input terminal S1 and the second signal input terminal S2 of the shift register 300_1 receive initial signals SP1 and SP2. In one embodiment, the shift register 600_1 can output the gate driving signals $G_1$ and $ST_1$ firstly, and then the registers 600_2, 600_3, 600_4 can output the gate driving signals $G_2$ to $G_4$ and $ST_2$ to $ST_4$ in turn. The shift register 600_5 is the last shift register to output the driving signals $G_5$ and $ST_5$ among the five shift registers 600_1 to 600_5.

Furthermore, the first input terminals IN1, the second input terminals IN2, and the third input terminals IN3 of the shift registers 600_1 and the 600_5 receive the clock signals HC1, HC2 and HC4. The first input terminal IN1, the second input terminal IN2, and the third input terminal IN3 of the shift register 600_2 receives the clock signals HC2, HC3 and HC1 respectively. The first input terminal IN1, the second input terminal IN2, and the third input terminal IN3 of the shift register 600_3 receive the clock signals HC3, HC4 and HC2 respectively. The first input terminal IN1, the second input terminal IN2, and the third input terminal IN3 of the shift register 600_4 receive the clock signals HC4, HC1 and HC3 respectively. The voltage levels of the clock signals HC1, HC2, HC3 and HC4 are switching between the high gate voltage VGH and the low gate voltage VGL. In addition, the voltage level of each of the clock signals HC1, HC2, HC3 and HC4 switches from low gate voltage VGL to high gate voltage VGH periodically and the clock signals HC1, HC2, HC3 and HC4 have the voltage level at high gate voltage VGH at different times without overlapping. In FIG. 8, the clocks signals HC1, HC2, HC3 and HC4 have the same period $T_P$, and the voltage levels of the clock signals HC1, HC2, HC3 and HC4 become high gate voltage VGH sequentially. In one embodiment of the present invention, the phase difference between clock signal HC2 and cock signal HC1 is 90°, the phase difference between clock signal HC3 and cock signal HC1 is 180°, the phase difference between clock signal HC4 and cock signal HC1 is 270.

Also, in one embodiment of the present invention, the shift register circuit 700 is operated according to the four clock signals HC1 to HC4, and thus is called a four phase shift register circuit. Consequently, the clock signals received by the three input terminals IN1 to IN3 of the $N^{th}$ shift register in shift register circuit 700 are the same as the clock signals received by the three input terminals IN1 to IN3 of the $(N+4)^{th}$ shift register in shift register circuit 700, wherein N is a positive integer. For example, the first input terminal IN1, the second input terminal IN2, and the third input terminal IN3 of the first shift register 600_1 receive the clock signals HC1, HC2, and HC4 respectively, and the first input terminal IN1, the second input terminal IN2, and the third input terminal IN3 of the first shift register 600_5 also receive the clock signals HC1, HC2, and HC4. However, the present invention is not limited to the aforesaid example. People with general related knowledge can also expand the phase number of the shift register circuit 700 according to the system needs.

Figure 9:
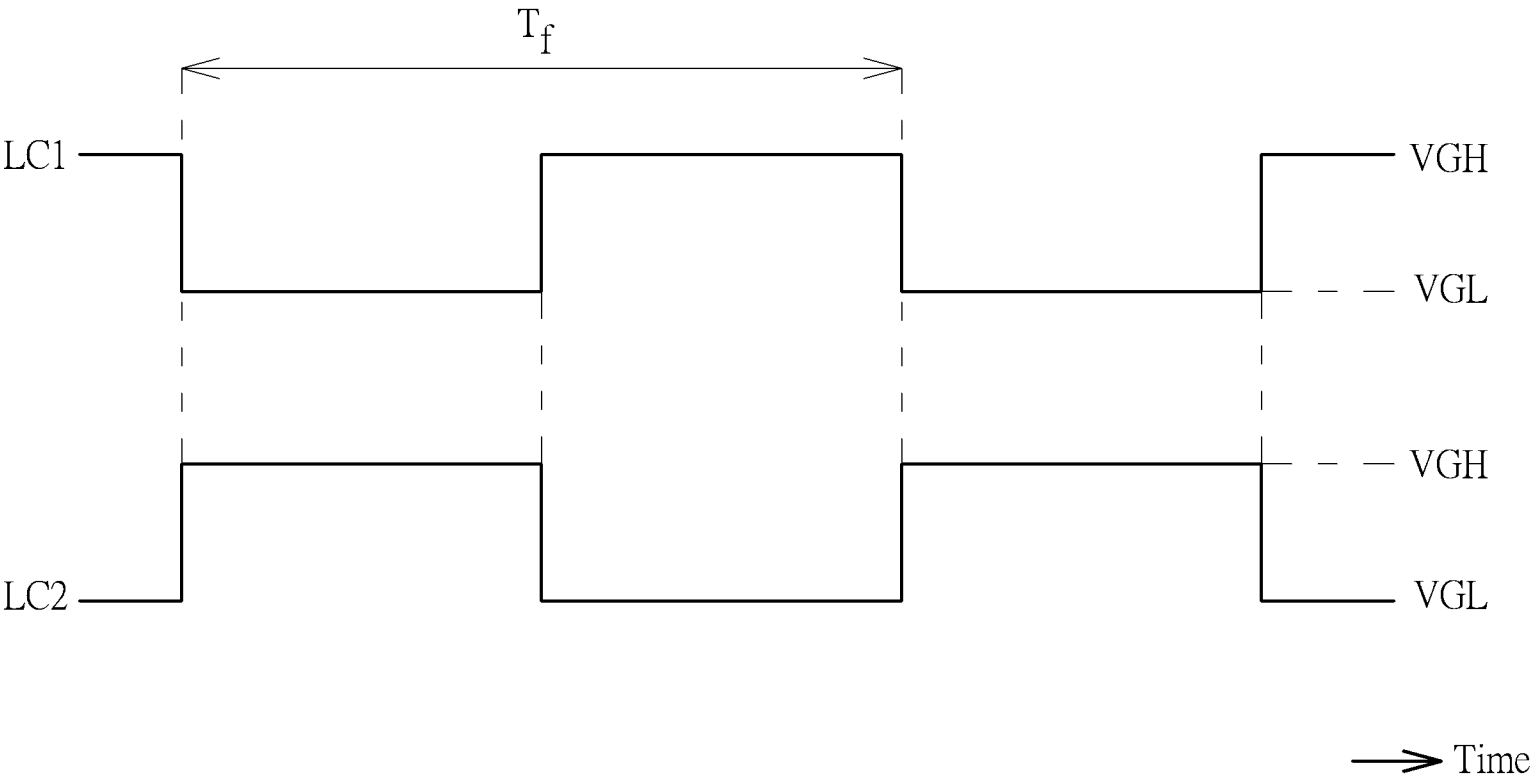
FIG. 9 shows a timing diagram of a second and a third system voltage of the shift register in FIG. 6.

FIG. 8 is the timing diagram of the shift register 600_1 of the shift register circuit 700 in FIG. 7. FIG. 8 explains the features and advantages of the shift register 600. In FIG. 8, the second system voltage terminal LC1 is at the high gate voltage VGH and the third system voltage terminal LC2 is at the low gate voltage VGL so the voltage level of the fourth node $K_N$ is kept at the low gate voltage VGL and the second stability pull-down circuit 670 is turned off. In this case, the first stability control circuit 640 and the first stability pull-down circuit 650 are used to pull down the voltage level of the node $Q_N$ and the gate driving signals $G_N$, and $ST_N$ to the low gate voltage VGL. In one embodiment of the present invention, the second system voltage terminal LC1 and the third system voltage terminal LC2 are switching between the high gate voltage VGH and the low gate voltage VGL after every period $T_f$ as shown in FIG. 9. When the second system voltage terminal LC1 is at the high gate voltage VGH, the third system voltage terminal LC2 is at the low gate voltage VGL. When the second system voltage terminal LC1 is at the low gate voltage VGL, the third system voltage terminal LC2 is at the high gate voltage VGH. Therefore, the transistors in the first stability control circuit 640, the first stability pull-down circuit 650, the second stability control circuit 660, and the second stability pull-down circuit 670 can be free from electronic characteristics shifting caused by operating under fixed voltage for long period of time, and the driving power of the transistors can be sustained. In addition, the structure of the second stability control circuit 660, and the second stability pull-down circuit 670 are same as the structure of the first stability control circuit 640, and the first stability pull-down circuit 650. Therefore, the second stability control circuit 660 and the second stability pull-down circuit 670 can be used to pull down the voltage level of the node $Q_N$ and the gate driving signals $G_N$, and $ST_N$ to the low gate voltage VGL when the third system voltage terminal LC2 is at the high gate voltage VGH. In this case, the voltage level of the fourth node $K_N$ can be seen as the voltage level of the node $P_N$ in FIG. 8. In one embodiment of the present invention, the period $T_f$ can be the time of a hundred frames of the display, however, this is not to limit the present invention.

Please refer FIGS. 6 and 8. During period T1, the voltage levels of clock signals HC1 and HC2 are both at low gate voltage VGL, the voltage level of the clock signal HC3 is changed from the high gate voltage VGH to the low gate voltage VGL, and the voltage level of the clock signal HC4 is changed from the low gate voltage VGL to the high gate voltage VGH. The voltage level of the gate driving signals $G_{N-1}$ and $ST_{N-1}$ are at the high gate voltage VGH, and the voltage level of the gate driving signal $ST_{N+2}$ is at the low gate voltage VGL. The switches T6A and T6B of the pull-up circuit 680 are turned on so the voltage level of the node $Q_N$ is pulled up to the same voltage level of the gate driving signal $G_{N-1}$, namely, the high gate voltage VGH, and the switches T3B and T6D of the driving circuit 610 are also turned on. Thus, the voltage level of the gate driving signal $G_N$ and $ST_N$ are kept at the same voltage level of the clock signal HC1, namely, the low gate voltage VGL. The switches T3K, T3L, and T3N of the stability driving circuit 620 are all turned off and the switch T3M is turned on so the voltage level of the node $Q'_N$ is kept at the low gate voltage VGL. Furthermore, the switches T3C, T3E, and T3F of the first stability control circuit 640 are turned on. However, since the driving power of the switch T3E is greater than the switch T3C, the switch T3D is turned off and the voltage level of the node $P_N$ is kept at the low gate voltage VGL. The switches T6F, T6G and T3H of the first stability pull-down circuit 650 are turned off, and the switches T6P, T6Q, and T3J of the main pull-down circuit 630 are also turned off.

During the period T2, the voltage level of clock signal HC1 is changed to the high gate voltage VGH, the voltage level of the clock signals HC2 and HC3 are at the low gate voltage VGL, and the voltage level of the clock signal HC4 is changed from the high gate voltage VGH to the low gate voltage VGL. The voltage level of the gate driving signals $G_{N-1}$ and $ST_{N-1}$ are changing to the low gate voltage VGL, and the voltage level of the gate driving signal $ST_{N+2}$ is also at the low gate voltage VGL. The switches TEA and T6B of the pull-up circuit 680 are turned off and the switches T3B and TED of the driving circuit 610 are still turned on. Thus, the voltage level of the gate driving signals $G_N$ and $ST_N$ are pulled up to the same voltage level of the clock signal HC1, namely, the high gate voltage VGH. The switches T3L, T3M, and T3N of the stability driving circuit 620 are all turned off and the switch T3K is turned on so the voltage level of the node $Q'_N$ is pulled up to the high gate voltage VGH. Meanwhile, the voltage level of the node $Q_N$ is pulled up to about 2 times the high gate voltage VGH, namely 2VGH, due to the coupling effect of the capacitor C1. Furthermore, the switches T3C, T3E, and T3F of the first stability control circuit 640 are turned on and the switches T3D and TEE are still turned off so the voltage level of the node $P_N$ is at the low gate voltage VGL. The switches T6F, T6G and T3H of the first stability pull-down circuit 650 remain turned off, and the switches T3P, T6Q and T3J of the main pull-down circuit 630 are also turned off.

During the period T3, the voltage level of clock signal HC1 is changed to the low gate voltage VGL, the voltage level of the clock signal HC2 is changed from the low gate voltage VGL to the high gate voltage VGH, and the voltage level of the clock signals HC3 and HC4 are at the low gate voltage VGL. The voltage level of the gate driving signals $G_{N-1}$ and $ST_{N-1}$ are at the low gate voltage VGL, and the voltage level of the gate driving signal $ST_{N+2}$ is also at the low gate voltage VGL. The switches TEA, T6B, and T6C of the pull-up circuit 680 are turned off. The switches T3K, T3M, and T3N of the stability driving circuit 620 are all turned off and the switch T3L is turned on so the voltage level of the node $Q'_N$ is at the high gate voltage VGH. Thus, the voltage level of the node $Q_N$ can be kept at a voltage level higher than the high gate voltage VGH. The switches T3B and TED of the driving circuit 610 remain turned on so the voltage level of the gate driving signals $G_N$ and $ST_N$ are pulled down to the same voltage level of the clock signal HC1, namely, the low gate voltage VGL. Furthermore, the switches T3C, T3E, and T3F of the first stability control circuit 640 are still turned on and the switches T3D and T6E are still turned off so the voltage level of the node $P_N$ is at the low gate voltage VGL. The switches T6F, T6G and T3H of the first stability pull-down circuit 650 remain turned off, and the switches T6P, T6Q and T3J of the main pull-down circuit 630 are also turned off.

During the period T4, the voltage level of clock signals HC1 and HC4 are at the low gate voltage VGL, the voltage level of the clock signal HC2 is changed from the high gate voltage VGH to the low gate voltage VGL, and the voltage level of the clock signal HC3 is changed from the low gate voltage VGL to the high gate voltage VGH. The voltage level of the gate driving signals $G_{N-1}$ and $ST_{N-1}$ are at the low gate voltage VGL, and the voltage level of the gate driving signal $ST_{N+2}$ is changed from the low gate voltage VGL to the high gate voltage. The switches T6A, T6B, and T6C of the pull-up circuit 680 are turned off. The switches T3K and T3L of the stability driving circuit 620 are all turned off and the switches T3M and T3M are turned on so the voltage level of the node $Q'_N$ is pulled down to the low gate voltage VGL. Meanwhile, since the switches T6P, T6Q and T3J of the main pull-down circuit 630 are turned on, the voltage level of the node $Q_N$ is pulled down to the low gate voltage VGL rapidly and the switches T3B and T6D of the driving circuit 610 are turned off. Furthermore, the switches T3E and T3F of the first stability control circuit 640 are turned off and the switches T3C, T3D, and T6E are turned on so the voltage level of the node $P_N$ is pulled up to the high gate voltage VGH. Thus, the switches T6F, T6G and T3H of the first stability pull-down circuit 650 are turned on, and the voltage level of the node $Q_N$ and the gate driving signals $G_N$ and $ST_N$ remain at the low gate voltage VGL stably.

According to the aforesaid embodiments of the present invention, the stability driving circuit 620 of the shift register 600_1 can keep the voltage level of the node $Q'_N$ at the high gate voltage VGH or the low gate voltage VGL according to the clock signals HC1, HC2 and HC4 and the gate driving signal $ST_{N+2}$ coming from the shift register two stages posterior. Consequently, the node $Q'_N$ can be free from floating. Meanwhile, during the period when the gate driving signal $G_N$ is pulled down by the shift register 600_1, the node $Q_N$ is kept at high voltage level and thus has stable power to pull down the voltage level of the gate driving signals $G_N$ and $ST_N$ to the low gate voltage VGL rapidly, ensuring the waveform of the gate driving signal outputted by the shift register remains correct and preventing the display panel from wrong charging or wrong judgment.

In addition, in the explanation above, clock signals HC1, HC2, HC3, and HC4 can also be called as a first clock signal, a second clock signal, a third clock signal, and a fourth clock signal. The shift register 300_1 can be called as a first shift register. The shift register 300_2 can be called as a second shift register. The shift register 300_3 can be called as a third shift register. The shift register 300_4 can be called as a fourth shift register. The capacitor C1 can be called as a first capacitor. The switches T3A and T6A can be called as a first input switch, and the switches T3K, T3L, T3M, and T3N can also be called as first to fifth switches respectively. The switch T6B can be called as a second input switch. The switch T6C can be called as a third input switch. Furthermore, the switched T3I and T6P can be called as a sixth switch. The switch T3J can be called as a seventh switch, and the switch T3C, T3E, T3D, and T3F can also be called as the eighth to eleven switches respectively. The switch T3G and T6F can be called as a twelve switch. The switch T3H can be called as a thirteen switch. The switch T6E can be called as a fourteen switch. The switch T6G can be called as a fifteen switch. The switches T6I, T6K, T6J, and T6L can be called as sixteen to nineteen switches respectively. The switch T6H can be called as a twenty switch. The switches T6M, T60, and T6N can be called as twenty-first to twenty-third switches respectively. The switch T6D can also be called as a twenty-fourth switch and the switch T6Q can be called as a twenty-fifth switch. Moreover, the nodes $Q_N$, $Q'_N$, $P_N$, and $K_N$ can be called as first node to fourth nodes respectively.

In summary, by using the shift register of the present invention, the gate driving signal can be generated correctly to serve the needs of the display. By considering the three different clock signals and the gate driving signals outputted from shift register of one stage prior and the shift register of two stages posterior, the shift register can keep the voltage level of the critical node in the driving circuit to the high gate voltage or the low gate voltage so that the floating node situation can be avoided. In addition, the stable high voltage level of the node can also help to pull down the gate driving signal accurately and rapidly. Consequently, shift register of the present invention can generate the waveform of the gate driving signal correctly and prevent the display panel from wrong charging or wrong judgment.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A shift register comprising:

a first input terminal;

a second input terminal;

a third input terminal;

a fourth input terminal;

a first signal input terminal;

a first output terminal;

a first system voltage terminal;

a second system voltage terminal;

a pull-up circuit coupled to the first signal input terminal and a first node for pulling up a voltage level of the first node according to a voltage level of the first signal input terminal;

a driving circuit coupled to the first node, the first input terminal and the first output terminal for controlling the electrical connection between the first input terminal and the first output terminal according to the voltage level of the first node;

a stability driving circuit comprising:

a capacitor having a first terminal directly coupled to the first node and a second terminal directly coupled to a second node;

a first switch having a first terminal directly coupled to the second system voltage terminal, a second terminal directly coupled to the second node, and a control terminal directly coupled to the first input terminal;

a second switch having a first terminal directly coupled to the second system voltage terminal, a second terminal directly coupled to the second node, and a control terminal directly coupled to the second input terminal;

a third switch having a first terminal directly coupled to the second node, a second terminal directly coupled the first system voltage terminal, and a control terminal directly coupled to the third input terminal; and a fourth switch having a first terminal directly coupled to the second node, a second terminal directly coupled to the first system voltage terminal, and a control terminal directly coupled to the fourth input terminal; and a pull-down circuit coupled to the first node, the first output terminal, the first system voltage terminal and the fourth input terminal for pulling down the voltage level of the first node and the first output terminal according to a voltage level of the fourth input terminal, wherein:

the first input terminal receives a first clock signal;

the second input terminal receives a second clock signal;

the third input terminal receives a third clock signal;

the first clock signal, the second clock signal and the third clock signal have a same frequency and same width of pulse;

the phase difference between the second clock signal and the first clock signal is 90°;

the phase difference between the third clock signal and the first clock signal is 270°; and the first clock signal, the second clock signal and the third clock signal persist in high voltage level non-simultaneously.

2. The shift register of claim 1, wherein the driving circuit comprises:

a fifth switch having a first terminal coupled to the first input terminal, a second terminal coupled to the first output terminal, and a control terminal coupled to the first node.

3. The shift register of claim 1, wherein the pull-up circuit comprises:

a first input switch having a control terminal receiving a first input signal, a first terminal coupled to the control terminal of the first input switch, and a second terminal coupled to the first node.

4. The shift register of claim 1, wherein the pull-down circuit comprises:

a main pull-down circuit coupled to the first node, the first system voltage terminal, the fourth input terminal and the first output terminal for pulling down the voltage level of the first output terminal and the first node according to the voltage level of fourth input terminal;

a first stability control circuit coupled to the first node, the first system voltage terminal and a third node for controlling a voltage level of the third node according to the voltage level of the first node;

a first stability pull-down circuit coupled to the first node, the first system voltage terminal, the first output terminal and the third node for pulling down the voltage level of the first node and the first output terminal according to the voltage level of the third node.

5. The shift register of claim 4, wherein the main pull-down circuit comprises:

a sixth switch having a first terminal coupled to the first node, a second terminal coupled to the first output terminal, and a control terminal coupled to the fourth input terminal; and a seventh switch having a first terminal coupled to the first output terminal, a second terminal coupled to the first system voltage terminal, and a control terminal coupled to the fourth input terminal.

6. The shift register of claim 4, wherein the first stability control circuit comprises:

an eighth switch having a first terminal coupled to the second system voltage terminal, a second terminal, and a control terminal coupled to the first terminal of the eighth switch;

a ninth switch having a first terminal coupled to the second terminal of the eighth switch, a second terminal coupled to the first system voltage terminal, and a control terminal coupled to the first node;

a tenth switch having a first terminal coupled to the second system voltage terminal, a second terminal coupled to the third node, and a control terminal coupled to the second terminal of the eighth switch; and an eleventh switch having a first terminal coupled to the third node, a second terminal coupled to a first system voltage terminal, and a control terminal coupled to the first node.

7. The shift register of claim 4, wherein the first stability pull-down circuit comprises:

a twelfth switch having a first terminal coupled to the first node, a second terminal coupled to the first output terminal, and a control terminal coupled to the third node; and a thirteenth switch having a first terminal coupled to the first output terminal, a second terminal coupled to the first system voltage terminal, and a control terminal coupled to the third node.

8. The shift register of claim 4, further comprising:

a second output terminal;

a second signal input terminal;

a third system voltage terminal; and a fourth node;

wherein the pull-down circuit further comprises:

a second stability control circuit coupled to the first node, the first system voltage terminal, the third system voltage terminal and the fourth node for controlling a voltage level of the fourth node according to the voltage level of the first node and the third system voltage terminal; and a second stability pull-down circuit coupled to the first node, the first output terminal, the second output terminal, the first system voltage terminal and the fourth node for pulling down the level voltage of the first node, the first output terminal and the second output terminal according to the voltage level of the fourth node.

9. The shift register of claim 8, wherein the first stability control circuit comprises:

an eighth switch having a first terminal coupled to the second system voltage terminal, a second terminal, and a control terminal coupled to the first terminal of the eighth switch;

a ninth switch having a first terminal coupled to the second terminal of the eighth switch, a second terminal coupled to the first system voltage terminal, and a control terminal coupled to the first node;

a tenth switch having a first terminal coupled to the second system voltage terminal, a second terminal coupled to the third node, and a control terminal coupled to the second terminal of the eighth switch;

an eleventh switch having a first terminal coupled to the third node, a second terminal coupled to the first system voltage terminal, and a control terminal coupled to the first node; and a fourteenth switch having a first terminal coupled to the second system voltage terminal, a second terminal coupled to the second terminal of the eighth switch, and a control terminal coupled to the second terminal of the fourteenth switch.

10. The shift register of claim 8, wherein the first stability pull-down circuit comprises:

a twelfth switch having a first terminal coupled to the first node, a second terminal coupled to the second output terminal, and a control terminal coupled to the third node;

a thirteenth switch having a first terminal coupled to the first output terminal, a second terminal coupled to the first system voltage terminal, and a control terminal coupled to the third node; and a fifteenth switch having a first terminal coupled to the second output terminal, a second terminal coupled to the first system voltage terminal, and a control terminal coupled to the third node.

11. The shift register of claim 8, wherein the second stability control circuit comprises:

a sixteenth switch having a first terminal coupled to the third system voltage terminal, a second terminal, and a control terminal coupled to the first terminal of the sixteenth switch;

a seventeenth switch having a first terminal coupled to the second terminal of the sixteenth switch, a second terminal coupled to the first system voltage terminal, and a control terminal coupled to the first node;

an eighteenth switch having a first terminal coupled to the third system voltage terminal, a second terminal coupled to the fourth node, and a control terminal coupled to the second terminal of the sixteenth switch;

a nineteenth switch having a first terminal coupled to the fourth node, a second terminal coupled to a first system voltage terminal, and a control terminal coupled to the first node; and a twentieth switch having a first terminal coupled to the third system voltage terminal, a second terminal coupled to the second terminal of the sixteenth switch, and a control terminal coupled to the second terminal of the twentieth switch.

12. The shift register of claim 8, wherein the second stability pull-down circuit comprises:

a twenty-first switch having a first terminal coupled to the first node, a second terminal coupled to the second output terminal, and a control terminal coupled to the fourth node;

a twenty-second switch having a first terminal coupled to the first output terminal, a second terminal coupled to the first system voltage terminal, and a control terminal coupled to the fourth node; and a twenty-third switch having a first terminal coupled to the second output terminal, a second terminal coupled to the first system voltage terminal, and a control terminal coupled to the fourth node.

13. The shift register of claim 8, wherein the second system voltage terminal and the third system voltage terminal have a same high and low voltage level, a same frequency but opposite phase.

14. The shift register of claim 8, wherein the driving circuit comprises:

a first switch having a first terminal coupled to the first input terminal, a second terminal coupled to the first output terminal, and a control terminal coupled to the first node; and a twenty-fourth switch having a first terminal coupled to the first input terminal, a second terminal coupled the second output terminal, and a control terminal coupled to the first node.

15. The shift register of claim 8, wherein the main pull-down circuit comprises:

a sixth switch having a first terminal coupled to the first node, a second terminal coupled to the second output terminal, and a control terminal coupled to the fourth input terminal;

a seventh switch having a first terminal coupled to the first output terminal, a second terminal coupled the first system voltage terminal, and a control terminal coupled to the fourth input terminal; and a twenty-fifth switch having a first terminal coupled to the second output terminal, a second terminal coupled to a first system voltage terminal, and a control terminal coupled to the fourth input terminal.

16. The shift register of claim 8, wherein the pull-up circuit comprises:

a first input switch having a first terminal coupled to the first signal input terminal, a second terminal, and a control terminal coupled to the second input terminal;

a second input switch having a first terminal coupled to the second terminal of the first input switch, a second terminal coupled to the first node, and a control terminal coupled to the second signal input terminal; and a third input switch having a first terminal coupled to the second terminal of the first input switch, a second terminal coupled to the first output terminal, and a control terminal coupled to the second terminal of the third input switch.

17. A shift register circuit having a plurality of shift registers, wherein each shift register comprises:

a first input terminal;

a second input terminal;

a third input terminal;

a fourth input terminal;

a first signal input terminal;

a first output terminal;

a first system voltage terminal;

a second system voltage terminal;

a pull-up circuit coupled to the first signal input terminal and a first node for pulling up a voltage level of the first node according to a voltage level of the first signal input terminal;

a driving circuit coupled to the first node, the first input terminal and the first output terminal for controlling the electrical connection between the first input terminal and the first output terminal according to the voltage level of the first node;

a stability driving circuit comprising:

a capacitor having a first terminal directly coupled to the first node and a second terminal directly coupled to a second node;

a first switch having a first terminal directly receiving a system high voltage level, a second terminal directly coupled to the second node, and a control terminal directly coupled to the first input terminal;

a second switch having a first terminal directly receiving the system high voltage level, a second terminal directly coupled to the second node, and a control terminal directly coupled to the second input terminal;

a third switch having a first terminal directly coupled to the second node, a second terminal directly coupled the first system voltage terminal, and a control terminal directly coupled to the third input terminal; and a fourth switch having a first terminal directly coupled to the second node, a second terminal directly coupled to the first system voltage terminal, and a control terminal directly coupled to the fourth input terminal; and a pull-down circuit coupled to the first node, the first output terminal, the first system voltage terminal and the fourth input terminal for pulling down the voltage level of the first node and the first output terminal according to a voltage level of the fourth input terminal, wherein:

the first input terminal receives a first clock signal;

the second input terminal receives a second clock signal;

the third input terminal receives a third clock signal;

the first clock signal, the second clock signal and the third clock signal have a same frequency and same width of pulse;

the phase difference between the second clock signal and the first clock signal is 90°;

the phase difference between the third clock signal and the first clock signal is 270°; and the first clock signal, the second clock signal and the third clock signal persist in high voltage level non-simultaneously.

18. A shift register circuit of claim 17, wherein the plurality of shift registers includes a first shift register, a second shift register, a third shift register and a fourth shift register;

wherein the first input terminal of the first shift register receives a first clock signal, the second input terminal of the first shift register receives a second clock signal, the third input terminal of the first shift register receives a third clock signal, and the fourth input terminal of the first shift register is coupled to the first output terminal of the third shift register;

wherein the first signal input terminal of the second shift register is coupled to the first output terminal of the first shift register, the first input terminal of the second shift register receives a second clock signal, the second input terminal of the second shift register receives a fourth clock signal, the third input terminal of the second shift register receives a first clock signal, and the fourth input terminal of the second shift register is coupled to the first output terminal of the fourth shift register;

wherein the first signal input terminal of the third shift register is coupled to the first output terminal of the second shift register, the first input terminal of the third shift register receives a fourth clock signal, the second input terminal of the third shift register receives a third clock signal, and the third input terminal of the third shift register receives a second clock signal; and wherein the first signal input terminal of the fourth shift register is coupled to the first output terminal of the third shift register, the first input terminal of the fourth shift register receives a third clock signal, the second input terminal of the fourth shift register receives a first clock signal, and the third input terminal of the fourth shift register receives a fourth clock signal.

19. The shift register circuit of claim 17, wherein the pull-down circuit comprises:

a main pull-down circuit coupled to the first node, the first system voltage terminal, the fourth input terminal and the first output terminal for pulling down the voltage level of the first output terminal and the first node according to the voltage level of fourth input terminal;

a first stability control circuit coupled to the first node, the first system voltage terminal and a third node for controlling a voltage level of the third node according to the voltage level of the first node; and a first stability pull-down circuit coupled to the first node, the first system voltage terminal, the first output terminal and the third node for pulling down the voltage level of the first node and the first output terminal according to the voltage level of the third node.

20. The shift register circuit of claim 19, wherein each shift registers further comprises:

a second output terminal;

a second signal input terminal;

a third system voltage terminal; and a fourth node;

wherein the pull-down circuit further comprises:

a second stability control circuit coupled to the first node, the first system voltage terminal, the third system voltage terminal and the fourth node for controlling a voltage level of the fourth node according to the voltage level of the first node and the third system voltage terminal; and a second stability pull-down circuit coupled to the first node, the first output terminal, the second output terminal, the first system voltage terminal and the fourth node for pulling down the level voltage of the first node, the first output terminal and the second output terminal according to the voltage level of the fourth node.

21. A shift register circuit of claim 20, wherein the plurality of shift registers includes a first shift register, a second shift register, a third shift register and a fourth shift register;

Wherein the first input terminal of the first shift register receives a first clock signal, the second input terminal of the first shift register receives a second clock signal, the third input terminal of the first shift register receives a third clock signal, and the fourth input terminal of the first shift register is coupled to the first output terminal of the third shift register;

wherein the first signal input terminal of the second shift register is coupled to the first output terminal of the first shift register, the second signal input terminal of the second shift register is coupled to the second output terminal of the first shift register, the first input terminal of the second shift register receives a second clock signal, the second input terminal of the second shift register receives a fourth clock signal, the third input terminal of the second shift register receives a first clock signal, and the fourth input terminal of the second shift register is coupled to the first output terminal of the fourth shift register;

wherein the first signal input terminal of the third shift register is coupled to the first output terminal of the second shift register, the second signal input terminal of the third shift register is coupled to the second output terminal of the second shift register, the first input terminal of the third shift register receives a fourth clock signal, the second input terminal of the third shift register receives a third clock signal, and the third input terminal of the third shift register receives a second clock signal; and wherein the first signal input terminal of the fourth shift register is coupled to the first output terminal of the third shift register, the second signal input terminal of the fourth shift register is coupled to the second output terminal of the third shift register, the first input terminal of the fourth shift register receives a third clock signal, the second input terminal of the fourth shift register receives a first clock signal, and the third input terminal of the fourth shift register receives a fourth clock signal.

22. The shift register circuit of claim 20, wherein the second system voltage terminal and the third system voltage terminal have a same high and low voltage level, a same frequency but opposite phase.

* * * * *